US006086446A

United States Patent [19]

Arriola

[11] Patent Number: 6,086,446

[45] Date of Patent: Jul. 11, 2000

[54] TRANSFORMABLE INSECT-LIKE TOY FIGURE

[75] Inventor: Martin F. Arriola, El Segundo, Calif.

[73] Assignee: Mattel, Inc, El Segundo

[21] Appl. No.: 09/244,939

[22] Filed: Feb. 4, 1999

[51] Int. Cl.[7] ..... A63H 3/46; A63H 13/10

[52] U.S. Cl. ..... 446/376; 446/72; 446/308; 446/435; 446/487

[58] Field of Search ..... 446/71, 72, 308, 446/309, 435, 487, 268, 368, 376; 40/417

[56] References Cited

U.S. PATENT DOCUMENTS

| | | | |
|---|---|---|---|
| 4,161,082 | 7/1979 | Alexander . | |
| 4,382,347 | 5/1983 | Murakami . | |
| 4,610,639 | 9/1986 | Piazza . | |
| 4,654,018 | 3/1987 | Farrington et al. | 446/38 |
| 4,710,146 | 12/1987 | Rasmussen et al. . | |
| 4,790,789 | 12/1988 | Mathis . | |
| 5,310,378 | 5/1994 | Shannon | 446/268 |
| 5,310,379 | 5/1994 | Hippely et al. . | |
| 5,701,878 | 12/1997 | Moore et al. . | |
| 5,924,910 | 7/1999 | Liu | 446/470 |

*Primary Examiner*—Kien T. Nguyen
*Assistant Examiner*—Laura Fossum
*Attorney, Agent, or Firm*—Roy A. Ekstrand

[57] ABSTRACT

A toy figure resembles a fanciful insect and includes a body supporting a head and a pair of arm-like appendages each supporting a hand. A pair of legs are secured to the body and coupled to feet which in turn support the body in a vertical stance. The body further supports a pair of pivotally coupled wing shells which in turn support a pair of pivotally coupled wings. With the wings and wing shells folded to the closed position, the appearance of an insect shell is provided. With the wing shells and wings pivoted to their respective outward positions, a wing spread approximately twice the normal wing spread is presented. Within the wing shells, a pair of projectile launchers are supported.

3 Claims, 1 Drawing Sheet

TRANSFORMABLE INSECT-LIKE TOY FIGURE

FIELD OF THE INVENTION

This invention relates generally to figures and particularly to those which are transformable between alternative appearance configurations.

BACKGROUND OF THE INVENTION

Perhaps one of the most interesting types of toys to emerge in recent years is found in the style of toys often referred to "transformers" or "transformable" toys. While the designs and appearances of such toys vary substantially, generally all provide a toy figure comprised of a plurality of multiply articulated members and appendages usually formed of a molded plastic material or the like. The articulated members are pivotable and movable in various often complex paths and orientations to provide the toys with the capability of being configurable into a plurality of relative positions. The combination of different relative positions thus provided alters the appearance and character features of the toy. In the majority of such toys, the multiply articulated elements are further enhanced with dramatic aesthetic elements to reinforce this duality of appearance. Thus, typical multiple configuration toys provide toy cars or truck vehicles which configure to form robots or the like. Similarly, transformable toys are configurable between appearances such as exaggerated monsters or other creatures and some type of mechanical or machine device such as a robot or the like. Further, such transformable toys often feature at least one appearance configuration which resembles an insect-like creature or monster.

U.S. Pat. No. 5,310,379 issued to Hippely, et al. sets forth a MULTIPLE CONFIGURATION TOY VEHICLE having an elongated chassis supported on a plurality of wheels. A rear support is pivotally secured to the rear of the chassis. A creature includes a center body, a rear body and a head. The head and rear body are pivotally secured to the center body. The rear body is removably securable to the rear support and includes foldable wings which open as the rear body pivots with respect to the center body.

U.S. Pat. No. 4,610,639 issued to Piazza sets forth a SIMULATED FLYING CREATURE WITH FLAPPABLE WINGS having an insect-like body defining a one-piece member providing wings which may be reciprocated by direct manual force to simulate flapping action. The creature may include legs which permit the creature to grasp an object for unassisted support thereon.

U.S. Pat. No. 4,654,018 issued to Farrington, et al. sets forth a FIGURE TOY WITH LAUNCHING MECHANISM FOR CONCEALED FLYING ELEMENT having an insect-like body including foldable wings which serve as covers for an interior cavity in the insect-like body. A rotational mechanism is operative within the insect body to rapidly rotate a pinwheel type flying device. When the wings are opened exposing the pinwheel device within the body cavity, the rotating mechanism launches the pin wheel device by rotating it rapidly.

U.S. Pat. No. 4,161,082 issued to Alexander sets forth a FIGURE TOY LIMB WITH TWIRLING HAND UNIT which provides a hollow limb frame such as an arm within which a shaft extending elbow to wrist is rotatably supported. The elbow end of the shaft supports a thumbwheel while the wrist end of the shaft supports a hand. As a result, when the user rotates the thumbwheel, the figure's hand correspondingly rotates.

U.S. Pat. No. 5,701,878 issued to Moore, et al. sets forth a TOY GUN HAVING A TRIGGER ASSEMBLY FOR AIMING AND LAUNCHING A PROJECTILE FROM A FLEXIBLE APPENDAGE in which a fanciful creature generally resembling a scorpion includes a flexible tail appendage. A projectile launcher is supported at the appendage tip and facilitates the launching of the projectile using the flexible appendage as a compressed air conduit between an internal plunger mechanism within the insect body and the projectile launcher.

U.S. Pat. No. 4,790,789 issued to Mathis sets forth a TOY FIGURE HAVING ADJUSTABLY MOVABLE JOINTS in which a threadably movable ring is secured to a joint in a manner providing a limit upon the degree of associated limb movement. Ball and socket joints are provided with integral stops to control direction of movement for realism.

U.S. Pat. No. 4,710,146 issued to Rasmussen, et al. sets forth a PROJECTILE PROPELLING ATTACHMENT FOR TOY FIGURES having a projectile launcher removably securable to a toy figure such as the arm thereof. The projectile launcher includes a spring tethered mechanism which further receives a projectile which is launched by energy stored in the spring.

While the foregoing described prior art devices have improved the art and have in some instances enjoyed commercial success, there remains nonetheless a continuing need in the art for evermore improved, interesting and amusing toy figures having a transformable or multi-purpose character.

SUMMARY OF THE INVENTION

Accordingly, it is a general object of the present invention to provide an improved toy figure. It is a more particular object of the present invention to provide an improved toy figure having a novel transformable feature. It is a still more particular object of the present invention to provide an improved transformable toy figure having an additional action feature such as launching a projectile.

In accordance with the present invention, there is provided a transformable toy figure comprising: a body, at least one pair of legs and at least one pair of arms and a rearwardly open cavity; a head supported on the body; a pair of wing shells pivotally secured to the body on opposed sides thereof, the wing shells being pivotable between an open position extending outwardly from the body in opposite directions and a closed position within the interior cavity, the wing shells each defining an outer edge; and a pair of wings each pivotally coupled to one of the outer edges of one of the wing shells, the wings being generally convex and pivotable between a closed position overlying the wing shells and an extended position in which the wings extend outwardly from the wing shells.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figures 1, 2, 3:
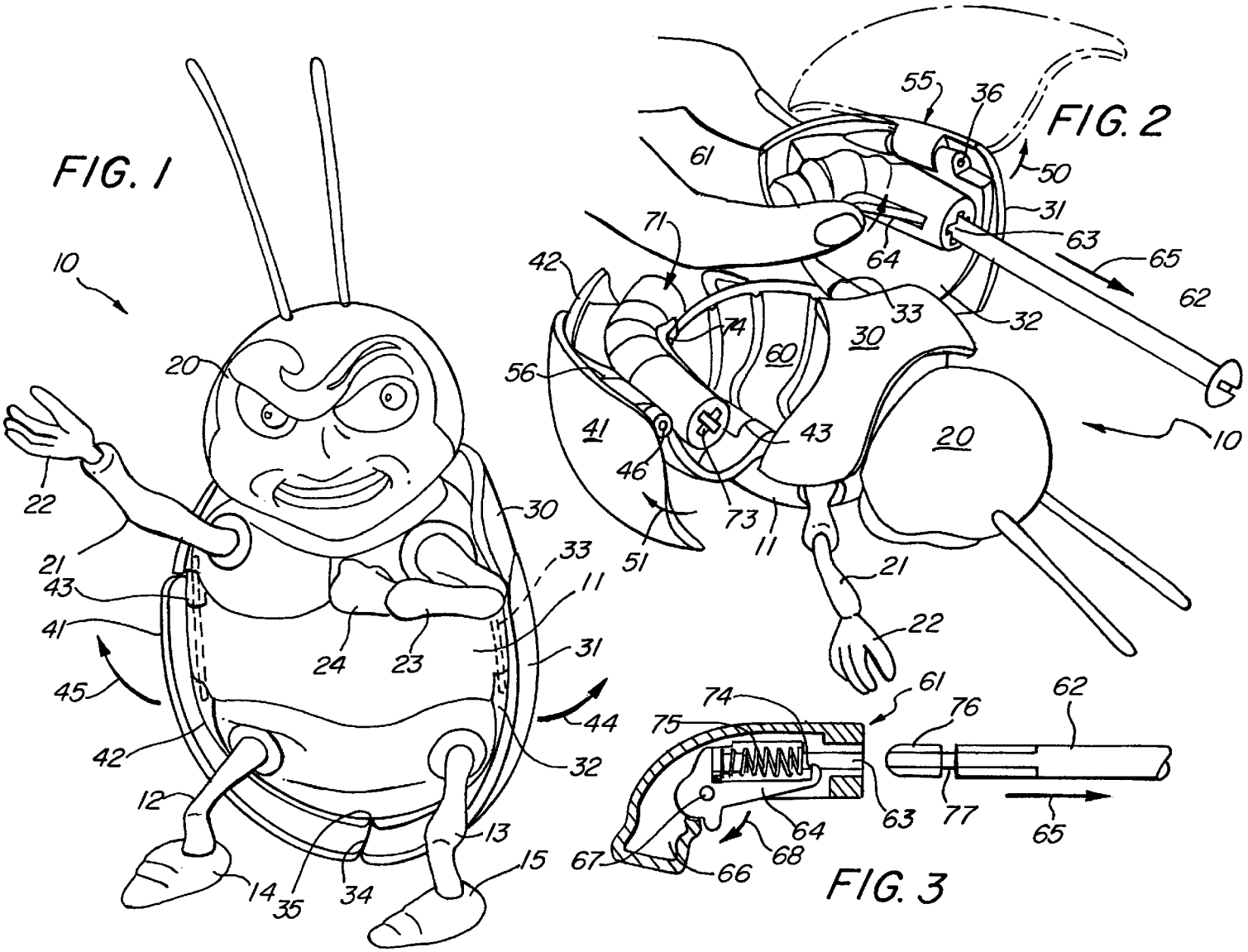
FIG. 1 sets forth a perspective view of a toy figure constructed in accordance with the present invention.
FIG. 2 sets forth a perspective view of the present invention toy figure in an alternate configuration.
FIG. 3 sets forth a partial section view of the projectile launching portion of the present invention toy figure.

FIG. 1 sets forth a front perspective view of a toy figure constructed in accordance with the present invention and generally referenced by numeral 10. Toy 10 is configured to resemble a fanciful depiction of an insect such as a "lady bug". However, it will be apparent to those skilled in the art that alternative aesthetic character may be used in fabricating FIG. 10 to provide different appearances and resemble different creatures both real and fanciful without departing from the spirit and scope of the present invention. In addition, toy FIG. 10 is preferably fabricated of a plurality of molded plastic components which may be mutually secured and attached using conventional fastening techniques such as snap-fit attachment, adhesive attachment and/or sonic or thermal welding.

More specifically, toy FIG. 10 includes a body 11 supporting a pair of legs 12 and 13 which in turn are supported by a pair of feet 14 and 15 respectively. Body 11 further supports a pair of arm-like appendages 21 and 23 which in turn support simulated hands 22 and 24 respectively. A head 20 is secured to body 11 by conventional fabrication attachment (not shown). A rear shell 30 is secured to the rear shoulder portion of body 11 using conventional fastening means (not shown). As is better seen in FIG. 2, body 11 further defines an interior cavity 60 which is open to the rear side of body 11.

In accordance with the present invention, toy FIG. 10 includes a pair of wing shells 32 and 42 pivotally secured to body 11 by a respective pair of hinges 33 and 43. Hinges 33 and 43 function to facilitate pivotal movement of wing shells 32 and 42 between the closed position shown in FIG. 1 and the extended position shown in FIG. 2. In further accordance with the present invention and as is better seen in FIG. 2, FIG. 10 includes a wing 31 coupled pivotally to wing shell 32 and a wing 41 coupled pivotally to wing shell 42. Wings 31 and 41 are pivotable outwardly in the directions indicated by arrows 44 and 45 allowing FIG. 10 to assume the configuration shown in FIG. 2.

In the closed position shown in FIG. 1, wing shells 32 and 42 meet to form a seam 35 therebetween. Similarly, in the closed position of FIG. 1, wings 31 and 41 meet in the closed position to form a seam 34.

Thus, in the closed configuration of FIG. 1, toy FIG. 10 provides a fanciful depiction of a lady bug type insect suitable for handheld play by the child user.

FIG. 2 sets forth a perspective view of the present invention toy figure transformed to its alternate configuration. The alternate configuration of toy FIG. 10 presents a wing spread type configuration which presents a total wing span approximately double the actual wing span of the figure due to the use of pivotally coupled wings and wing shells on each side of the body. In addition, the extended or wing spread configuration of FIG. 2 also exposes a pair of projectile launchers 61 and 71 which may be used in launching appropriately formed projectiles such as projectile 62.

More specifically, toy FIG. 10 includes a body 11 defining an interior cavity 60 and supporting a rear shell 30. Body 11 further supports head 20 together with arms 21 and 23 as well as legs 12 and 13 (all seen in FIG. 1).

In accordance with the present invention, a hinge 33 supports a wing shell 32 in a pivotal attachment to one side of body 11. Wing shell 32 in turn supports a projectile launcher 61 and a hinge 55. Hinge 55 pivotally couples wing 31 to wing shell 32. Hinge 33 is aligned with respect to body 11 such that projectile launcher 61 is directed generally forwardly with respect to body 11 and head 20. Hinge 55 is conventional in fabrication and includes a hinge pin 36.

Similarly, a hinge 43 pivotally secures wing shell 42 to the opposite side of body 11. Wing shell 42 further includes a hinge 56 having a hinge pin 46 which pivotally secures wing 41 to wing shell 42. In further similarity to wing shell 32 and wing 31, a projectile launcher 71 is secured to the interior surface of wing shell 42. Projectile launchers 61 and 71 are substantially identical. Thus, launcher 61 includes a cruciform-shaped passage 63 and a trigger button 64. Similarly, launcher 71 includes a cruciform-shaped passage 73 and a trigger button 74. The fabrication of launchers 61 and 71 is set forth below in FIG. 3 in greater detail. However, suffice it to note here that launcher 61 receives a projectile 62 against the force of an internal spring and upon pressing of trigger 64 releasing the internal spring, projectile 62 is launched in the direction indicated by arrow 65. While not seen in FIG. 2, it will be understood that launcher 71 is substantially identical and thus is able to perform a corresponding projectile launch.

In accordance with the present invention, toy FIG. 10 is configurable between the extended wing spread position of FIG. 2 and the closed configuration of FIG. 1 by simple pivotal movement of wings 31 and 41 and wing shells 32 and 42. Thus, toy figure 10 may be played with in a conventional play pattern or, alternatively, may assume a fanciful figure configuration in which a "war-like" appearance and manifestation is provided.

FIG. 3 sets forth a section view of launcher 61 which will be understood to be equally descriptive of launcher 71. Accordingly, launcher 61 is secured within wing shell 32 using conventional attachment apparatus such as adhesive bonding or the like. Launcher 61 defines an interior cavity 66 within which a trigger 64 is pivotally supported by a pivot pin 67. A cruciform-shaped passage 63 extends inwardly to the interior of cavity 66. Passage 63 is cruciform-shaped to provide a safety factor for the launcher of the present invention toy figure by preventing the insertion of dangerous implements such as pencils, pens or the like into the projectile launcher.

Within launcher 61, trigger lever 64 includes a lock tab 74 positioned forwardly of a power spring 75. In operation, a projectile 62 having an elongated body defining an end 76 and defining a cruciform shape corresponding to passage 63 is forced inwardly through passage 63 against spring 75. Projectile 62 defines a groove 77 which receives tab 74 as projectile 62 is inserted and as spring 75 is compressed. The locking action of tab 74 within groove 77 secures projectile 62 and completes the loading action of projectile launcher 61.

Launching projectile 62 is accomplished by simply pressing trigger 64 in the direction indicated by arrow 68. This pivotal movement about pin 67 moves tab 74 out from groove 77 releasing projectile 62. The energy stored within spring 75 accelerates projectile 62 outwardly in the direction indicated by arrow 65.

What has been shown is a transformable insect-like toy figure which utilizes a double set of folding wings to present a transformation of the figure from a closed position to a substantially wider wing spread configuration in a simple, low cost and effective manner. A pair of projectile launchers hidden within the figure in the closed position are exposed in the wing spread position and are able to launch projectiles in a simulated combat or war-like activity. The entire figure may be fabricated of relatively low cost, high volume, mass produceable molded plastic components or the like.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A transformable toy figure comprising:

a body, at least one pair of legs and at least one pair of arms and a rearwardly open cavity;

a head supported on said body;

a pair of wing shells each defining an inner surface and having a projectile launcher supported by said inner surface pivotally secured to said body on opposed sides thereof, said wing shells being pivotable between an open position extending outwardly from said body in opposite directions and a closed position within said interior cavity, said wing shells each defining an outer edge, each of said projectile launchers having a launchable projectile therein; and a pair of wings each pivotally coupled to one of said outer edges of one of said wing shells, said wings being generally convex and pivotable between a closed position overlying said wing shells and an extended position in which said wings extend outwardly from said wing shells.

2. The transformable toy figure set forth in claim 1 wherein said wings each define a convex shape and in said closed position form a convex surface for said toy figure.

3. The transformable toy figure set forth in claim 2 wherein said wings define cooperating inner edges which meet to form a seam in said closed position.

* * * * *